US010207493B2

(12) United States Patent
D'Annunzio

(10) Patent No.: US 10,207,493 B2
(45) Date of Patent: Feb. 19, 2019

(54) MACHINE FOR INDIRECT INK-JET PRINTING

(71) Applicant: BOBST FIRENZE S.R.L., Campi Bisenzio (FI) (IT)

(72) Inventor: Federico D'Annunzio, Florence (IT)

(73) Assignee: BOBST FIRENZE S.R.L. (IT)

( * ) Notice: Subject to any disclaimer, the term of this patent is extended or adjusted under 35 U.S.C. 154(b) by 0 days.

(21) Appl. No.: 15/572,225

(22) PCT Filed: May 19, 2016

(86) PCT No.: PCT/IB2016/052930

§ 371 (c)(1),
(2) Date: Nov. 7, 2017

(87) PCT Pub. No.: WO2016/189433

PCT Pub. Date: Dec. 1, 2016

(65) Prior Publication Data

US 2018/0126727 A1 May 10, 2018

(30) Foreign Application Priority Data

May 22, 2015 (IT) ..... 102015000016780

(51) Int. Cl.
*B41J 2/005* (2006.01)
*B41F 13/24* (2006.01)
(Continued)

(52) U.S. Cl.
CPC ..... *B41J 2/0057* (2013.01); *B41F 13/24* (2013.01); *B41F 13/30* (2013.01); *B41F 31/08* (2013.01); *B41F 31/28* (2013.01); *B41J 25/304* (2013.01)

(58) Field of Classification Search
CPC ..... B41J 2/0057; B41J 25/304; B41F 13/24; B41F 13/30; B41F 31/08; B41F 31/28
(Continued)

(56) References Cited

U.S. PATENT DOCUMENTS 5,966,157 A * 10/1999 Dolan ..... B41J 2/005 101/91
2013/0051828 A1* 2/2013 Yogosawa ..... G03G 15/5058 399/66
2017/0043570 A1 2/2017 Bastici et al.

FOREIGN PATENT DOCUMENTS

EP 1 151 862 A2 11/2001
EP 2 399 744 A1 12/2011
WO WO 2005/028202 A1 3/2005

OTHER PUBLICATIONS

International Search Report dated Sep. 21, 2016 in corresponding PCT International Application No. PCT/IB2016/052930.
(Continued)

*Primary Examiner* — Huan H Tran
*Assistant Examiner* — Alexander D Shenderov
(74) *Attorney, Agent, or Firm* — Ostrolenk Faber LLP

(57) ABSTRACT

A machine for indirect ink-jet printing and more generally to a machine for indirect digital printing. A first transfer roller is at a printing position at which it provides ink to a first printing roller. The first printing roller engages and transfers ink onto a counter roller for the printing. When its printing has been completed, the first printing roller is moved to a storage position. A second printing roller is selectively moved from a waiting position to the working position to provide ink. The rollers are moved along guides between their positions.

9 Claims, 2 Drawing Sheets

(51) Int. Cl.

| | |
|---|---|
| ***B41F 31/08*** | (2006.01) |
| ***B41F 31/28*** | (2006.01) |
| ***B41F 13/30*** | (2006.01) |
| ***B41J 25/304*** | (2006.01) |

(58) Field of Classification Search
USPC ..... 347/103
See application file for complete search history.

(56) References Cited

OTHER PUBLICATIONS

Written Opinion dated Sep. 21, 2016 in corresponding PCT International Application No. PCT/IB2016/052930.

* cited by examiner

MACHINE FOR INDIRECT INK-JET PRINTING

CROSS-REFERENCE TO RELATED APPLICATIONS

The present application is a 35 U.S.C. §§ 371 national phase conversion of PCT/IB2016/052930, filed May 19, 2016, which claims priority of Italian Patent Application No. 102015000016780, filed May 22, 2015, the contents of which are incorporated by reference herein. The PCT International Application was published in the English language.

TECHNICAL FIELD OF THE INVENTION

The present invention relates to an improved machine for indirect ink-jet printing and more generally to a machine for indirect digital printing.

BACKGROUND OF THE INVENTION

At present, in the printing sector, and in particular in the sector relating to the printing of labels and flexible wrappers, flexographic printing machines which have been adapted with ink-jet printing heads are known. The application of ink-jet printing heads to flexographic printing units allows printing to be personalized with so-called "variable data", said data ensuring that repetition of a print is not the same as the next print, modifying in succession one print in relation to the other one.

Also known are indirect ink-jet printing machines which perform a first transfer of the image onto an intermediate medium, using the ink-jet printing method. The intermediate medium moves at the same line speed as the printing medium. When the intermediate medium comes into contact with the printing medium, the intermediate medium, performs ink transfer by the offset printing method. At the time of transfer from the intermediate medium to the printing medium, the ink is still liquid or in semi-liquid.

The advantages of indirect printing together over those of ink-jet printing are many. For example, it is possible to perform printing on a greater variety of printing media types owing to the possible application of any pressure to the ink transfer step, as in flexographic printing and, in particular, offset printing.

However, this type of machine also has certain drawbacks. In particular, it is affected by the problem of latent image, namely the defect which arises on the printing medium when complete transfer of the ink during the previous step is not obtained. A way of overcoming this problem is to perform calibration between the ink-jet repetitions, namely ensure that each ink drop of a successive repetition is transferred exactly onto the same point of the preceding repetition, within the same image portion. However, this would involve having to adapt the mechanical system of the image transfer system, namely the intermediate medium, to the specific format of the printed images. This type of operation among other things would require very long set-up times which would cancel out the advantages of ink-jet printing.

In order to avoid this, namely ensure that the mechanics of the image transfer system are independent of the dimensions of the print format, as in the case of flexographic printing machines, cleaning systems have been implemented in order to clean the surface of the intermediate printing medium and eliminate the latent image defect without having to re-calibrate the mechanics and in particular the arrangement of the intermediate medium.

However, these cleaning systems also have certain drawbacks. They are in fact costly and often inefficient. Furthermore they require a lot of maintenance.

SUMMARY OF THE INVENTION

The object of the present invention is to provide an indirect digital printing machine and in particular an ink-jet printing machine which solves these problems, namely achieves the advantages of flexographic printing and digital printing, without however having the aforementioned drawbacks.

These results are achieved by a printing unit for a printing machine according to the present invention, the essential characteristic features of which are described herein.

BRIEF DESCRIPTION OF THE DRAWINGS

The characteristic features and advantages of the printing unit according to the present invention will emerge clearly from the following detailed description of preferred embodiments thereof, provided by way of a non-limiting example, with reference to the attached Figures in which.

DETAILED DESCRIPTION OF THE INVENTION

Figure 1:
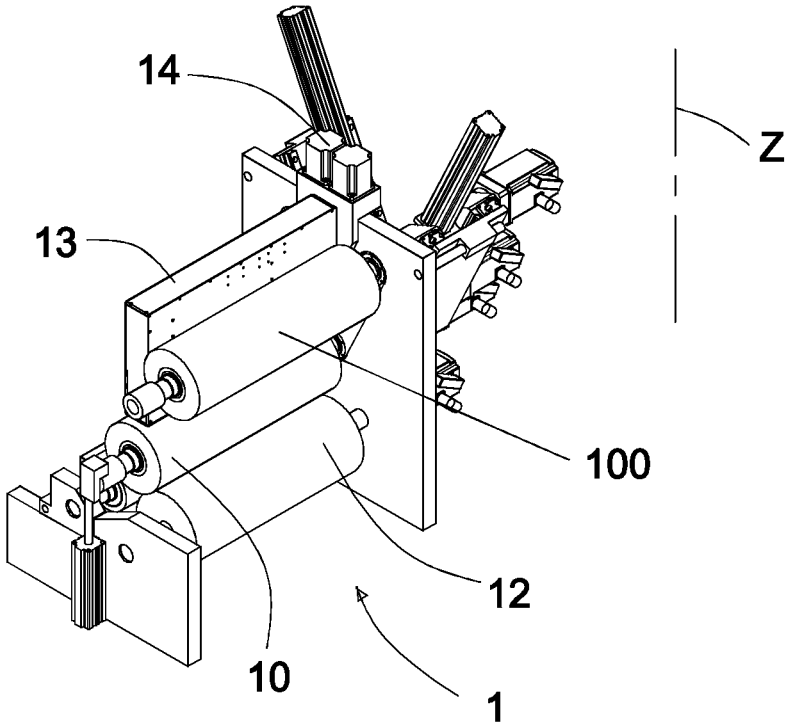
FIG. 1 shows a perspective view of a printing unit according to the invention.
Figure 2:
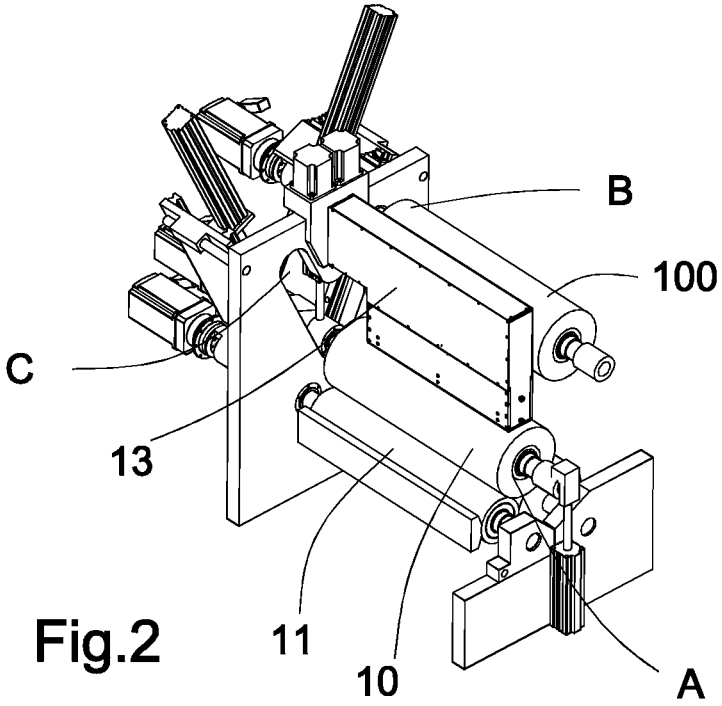
FIG. 2 shows a second perspective view of the printing unit according to FIG. 1.
Figure 3:
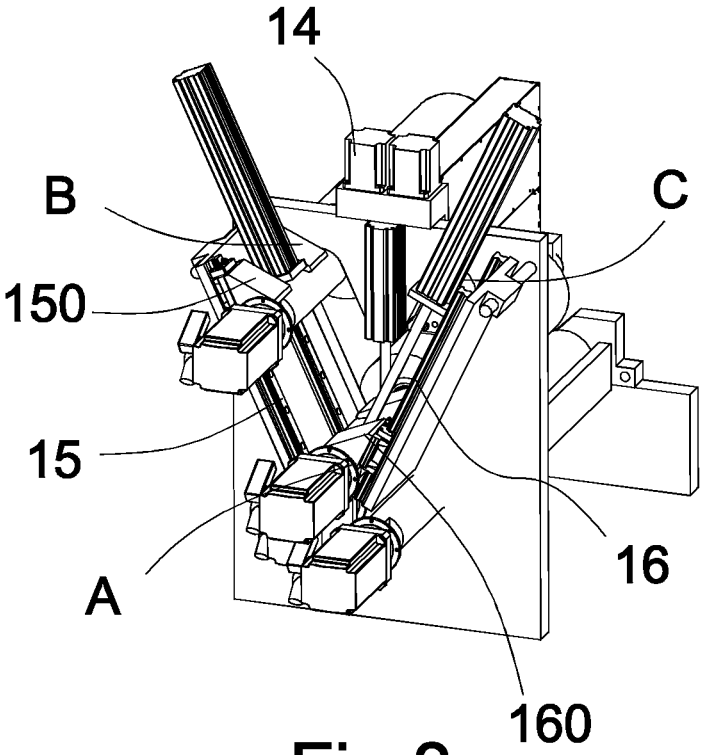
FIG. 3 is a rear view of the printing unit according to the preceding Figures.

With reference to the aforementioned Figures, a printing machine comprises at least one printing unit denoted overall by the reference number 1. The printing unit, according to a typical configuration of flexographic printing machines, comprises at least two mutually tangential and counter-rotating rollers, i.e. a first printing roller 10 and a counter-roller 12.

Optionally a third roller or anilox cylinder 11 may be provided as described further below in the continuation of the description.

As mentioned, this configuration is known and therefore is not further described in detail.

The printing unit also comprises a digital head 13 designed to produce an ink jet, using the known technology of ink-jet printing machines. The ink-jet printing head 13, i.e. the digital head, is known in itself and per se and therefore is not described in detail. The head may, as mentioned above, be a head for ink-jet printing, but in general is a head for any digital printing technique in the broad sense.

The digital head 13 is positioned to press against the printing roller 10, namely so that the ink jet produced by the digital head is transferred onto the printing roller and thereafter onto the printing medium.

Advantageously, in the preferred construction, the digital head 13 is located above the printing roller 10 along a vertical axis Z. The ink jet is therefore formed substantially along this vertical axis Z.

Furthermore, the digital head 13 is associated with movement means which perform the displacement of the digital head towards and/or away from the printing roller 10 along the vertical axis Z. In the construction shown, these movement means comprise an electrical actuating system 14. However, other solutions for moving the digital head may also be implemented.

In a further aspect of the invention, the printing unit also comprises a second printing roller 100 configured to be substituted for the first printing roller by a quick change-over procedure.

In particular, the printing unit comprises a working position A which is assumed by the printing roller 10 in operation. When the printing roller is in the working position, it is positioned in mutual contact with a counter-roller in order to allow the transfer of ink to the printing medium (not shown). In this working position, the digital head presses against the printing roller 10 as described above. The printing unit also comprises at least one waiting position B operatively connected to the working position via transfer means 15. The second printing roller 100 is located in the waiting position B, while the first printing roller is in the working position A.

At the end of the printing step, the first exhausted printing roller 10 is removed and the second fresh printing roller 100 which previously was in the waiting position B takes its place in the working position A, from which the first printing roller 10 had been removed. Advantageously, in the first preferred constructional variant, this movement is automated. The transfer means may, for example, take the form of at least one guide rail 15 which extends from the waiting position to the working position. The second printing roller 100 is slidingly associated with this guide rail 15 by means of a carriage 150 which carries a chuck on which the printing roller is mounted. The carriage may be for example operated by a pneumatic or oil-hydraulic or electrical actuator.

Furthermore, in a preferred construction solution, the printing unit comprises three positions, i.e. a working position A, a waiting position B and a removal position C. Additional transfer means 16 are provided in order to connect operatively the working position to the removal position. In particular, at the end of the printing step, the first printing roller is transferred from the working position A to the removal position C and at the same time the second printing roller 100 is transferred from the waiting position B to the working position A. The working position is intermediate in relation to the waiting position and the removal position, i.e. it is situated between these two positions.

In this case also, the additional transfer means may take the form of a guide rail 16 on which the first printing roller is slidingly associated by means of carriage 160. The movement of the carriage 160 may be controlled by a pneumatic or oil-hydraulic actuator.

An implementation of this technical solution is described in detail in Italian patent application No. MI2014A000784 in the name of the same Applicant. The text of that patent is cited herein and incorporated by reference herein. This solution, however, is only one of the possible constructional solutions which may be envisaged in order to perform the rapid change-over of the printing rollers.

In order to perform the substitution of the printing roller 10, the printing head 13 is moved away from the first printing roller 10, which is thus removed from the working position A, and is replaced by the second printing roller 100. Once this substitution has been performed, the digital head 13 is repositioned at the correct distance from the second printing roller 100 (fixed optimum distance from the intermediate medium, in order to perform the correct transfer of the ink onto the medium).

Advantageously, owing to the possibility of varying the position of the digital head 13 along the axis Z, it is also possible to use printing rollers with different formats. In fact, if the substitute second printing roller 100 has a format bigger than that of the first printing roller 10, which has been removed, the digital head 13 is positioned at a different height along the axis Z, while maintaining a constant and optimum distance from the printing roller and consequently form the intermediate medium.

The printing machine according to the invention may have one or more of the printing units described above.

As mentioned above, optionally a third roller or anilox cylinder 11 may be provided, so as to allow the unit to be used as a conventional flexographic printing unit. In that case, the digital head 13 is inoperative.

With the printing unit described above, both selective and sequential change-over of the printing rollers is possible.

In the case of a selective change-over, if it is required to change only one printing roller for example, in order to obtain a new text, a new language, etc., the change-over may be performed instantaneously without any wastage of material due to machine stoppage and consequent loss of the printing register. The machine does not stop, the change-over is performed on the selected printing station, without losses or wastage of any type, immediately and perfectly in register.

Instead, in the case of a sequential change-over, changing of the printing rollers is performed starting from a first printing unit, in which the "new" printing roller replaces the "old" roller and starts to print the "new" work. The "old" work continues its path as far as a second printing unit and, when the "new" printed work arrives from the first printing unit, the "new" printing roller of the second unit takes the place of the "old" roller, printing the second color of the "new" work, perfectly in register with the first color of the preceding work, without any wastage between "old" and "new" work. The "old" work continues its path as far as a third printing unit and, when the "new" printed work arrives from the first and second printing unit, the "new" printing roller of the third unit takes the place of the old roller, printing the third color of the "new" work, perfectly in register with the first and second colors of the "new" work, without any wastage between "old" and "new" work. This continues for all the successive printing units, wherein the procedure continues with a sequential replacement of the "old" work with the "new" work without leaving wastage of material between the two jobs.

The printing unit and more generally the printing machine according to the invention solve the problems described above.

In particular, there is a combination of a digital head 13 with at least two printing rollers 10, 100. One of the printing rollers may be rapidly moved in order to substitute for the first roller and to obtain an unexpected and particularly advantageous synergistic effect. In detail, owing to the presence of the digital ink-jet head 13, it is possible to combine the advantages of flexographic printing with those of indirect ink-jet printing owing to the incorporation of the system for rapid change-over of the printing rollers. With this system, it is possible to change the format of the printing rollers very rapidly. By printing new images always on an intermediate surface of suitable format it is possible to eliminate the latent image defect. Owing to very precise synchronization of the ink jet on the surface of the intermediate medium from one repetition to another, it is possible to ensure a perfect dot-on-dot jet.

Furthermore, the worn roller is replaced with a new one and there is no need for costly and complex cleaning systems.

As mentioned above, the solution with an ink-jet printing head is only one of the possible options, since the printing unit according to the invention may also be fitted with heads for other types of digital printing.

The present invention has been described hitherto with reference to preferred embodiments thereof. It is to be understood that each of the technical solutions implemented in the preferred embodiments described here by way of example may be advantageously combined in various ways with each other, so as to give rise to other embodiments which relate to the same inventive idea, but all falling within the scope of protection of the claims provided hereinbelow.

The invention claimed is:

1. A printing unit configured for an indirect digital printing machine, the printing unit comprising:

a plurality of rollers which are mutually tangential and counter-rotating for transferring ink to a printing support, the plurality of rollers comprising at least a first printing roller and a counter-roller;

a printing head configured for emitting ink onto the first printing roller when the first printing roller is in a working position at the counter-roller;

a displacement device configured for moving the printing head towards and away from the first printing roller;

a second printing roller initially arranged in a respective waiting position spaced from the working position;

a transfer device configured for operating between the waiting position and the working position, the transfer device is connected to the second printing roller for moving the second printing roller from the waiting position to the working position;

when the first printing roller ends a printing cycle, the first printing roller is configured to be removed from the working position, and the second printing roller is configured for substituting the second printing roller for the first printing roller at the working position;

a removal position spaced from the working position;

an additional transfer device which operates between the working position and the removal position;

the first printing roller being connected to the additional transfer device for the first printing roller being moved by the additional transfer device from the working position to the removal position; and the transfer device and the additional transfer device each comprise a guide rail extending respectively between the waiting position and the working position and between the working position and the removal position, the first and the second printing rollers being slidingly associated with each of the rails for sliding along the rails.

2. The printing unit according to claim 1, wherein the substitution of the first printing roller with the second printing roller is automated.

3. An indirect digital printing machine comprising at least one printing unit according to claim 1.

4. A method for changing a printing roller in an indirect digital printing machine comprising:

providing at least a printing unit comprising:

a plurality of rollers which are mutually tangential and counter-rotating for transferring ink to a printing support, the plurality of rollers comprising at least a first printing roller and a counter-roller;

a printing head configured for emitting ink onto the first printing roller when the first printing roller is in a working position at the counter-roller;

a displacement device configured for moving the printing head towards and away from the first printing roller;

a second printing roller initially arranged in a respective waiting position spaced from the working position;

a transfer device configured for operating between the waiting position and the working position, the transfer device is connected to the second printing roller for moving the second printing roller from the waiting position to the working position;

when the first printing roller ends a printing cycle, the first printing roller is configured to be removed from the working position and the second printing roller substituting the second printing roller for the first printing roller at the working position;

the method comprising the steps of:

moving the printing head away from the first printing roller then in the working position;

removing the first printing roller from the working position;

moving, by means of the transfer device, the second printing roller from the waiting position into the working position to thereby substitute the second printing roller for the first printing roller at the working position;

moving the printing head towards the second printing roller when the second printing roller is in the working position.

5. A method according to claim 4, wherein the printing unit also comprises a removal position and an additional transfer device operating between the working position and the removal position;

the method further comprising, during the step of its removal, the first printing roller is moved from the working position to the removal position by means of the additional transfer device.

6. A method according to claim 5, wherein the transfer device and an additional transfer device each comprise a guide rail extending respectively between the waiting position and the working position and between the working position and the removal position, the method further comprising:

the first and the second rollers are slidingly associated with each of the rails, so that the removal step and the changing step involve respectively the sliding movement of the first printing roller on one guide rail from the working position to the removal position and the sliding movement of the second printing roller on the other rail from the waiting position to the working position.

7. A method according to claim 5, wherein the step of removing the first printing roller from the working position and the step of changing the first printing roller to be substituted by the second printing roller in the working position are performed simultaneously.

8. A method according to claim 4, wherein the step of removing the first printing roller from the working position and the step of changing the first printing roller to be substituted by the second printing roller in the working position are performed simultaneously.

9. A printing unit configured for an indirect digital printing machine, the printing unit comprising:

a plurality of rollers which are mutually tangential and counter-rotating for transferring ink to a printing support, the plurality of rollers comprising at least a first printing roller and a counter-roller;

a printing head configured for emitting ink onto the first printing roller when the first printing roller is in a working position at the counter-roller;

a displacement device configured for moving the printing head towards and away from the first printing roller;

a second printing roller initially arranged in a respective waiting position spaced from the working position;

a transfer device configured for operating between the waiting position and the working position, the transfer device is connected to the second printing roller for moving the second printing roller from the waiting position to the working position;

when the first printing roller ends a printing cycle, the first printing roller is configured to be removed from the working position, and the second printing roller is configured for substituting the second printing roller for the first printing roller at the working position;

a removal position spaced from the working position;

an additional transfer device which operates between the working position and the removal position;

the first printing roller being connected to the additional transfer device for the first printing roller being moved by the additional transfer device from the working position to the removal position;

the working position is located between the removal position and the waiting position; and the transfer device and the additional transfer device comprise guide rails extending respectively between the waiting position and the working position and between the working position and the removal position, the first and the second rollers being slidingly associated with each of the rails for sliding along the rails.

* * * * *